US007681616B2

(12) United States Patent
Marschand et al.

(10) Patent No.: US 7,681,616 B2
(45) Date of Patent: Mar. 23, 2010

(54) CORRECTION TAPE APPLICATOR TIP WITH CYLINDRICAL PROJECTION

(75) Inventors: Bret R. Marschand, Glendale Heights, IL (US); John Thompson, Medfield, MA (US); Frank Peterson, Lisle, IL (US)

(73) Assignee: Sanford, L.P., Oak Brook, IL (US)

( * ) Notice: Subject to any disclaimer, the term of this patent is extended or adjusted under 35 U.S.C. 154(b) by 380 days.

(21) Appl. No.: 11/618,596

(22) Filed: Dec. 29, 2006

(65) Prior Publication Data

US 2007/0107851 A1 May 17, 2007

Related U.S. Application Data

(63) Continuation of application No. 10/756,042, filed on Jan. 13, 2004, now Pat. No. 7,163,040.

(51) Int. Cl.
*B32B 37/26* (2006.01)
*B26F 3/02* (2006.01)
*B43L 19/00* (2006.01)

(52) U.S. Cl. ..... 156/577; 156/523; 156/527; 156/579; 118/76; 118/200; 118/257; 242/588; 242/588.3; 242/588.6; 242/160.2; 242/160.4; 242/170; 242/171; 206/411

(58) Field of Classification Search ..... 156/523, 156/574, 577, 579, 527; 118/76, 200, 257; 225/46; 242/160.2, 160.4, 170, 171, 588, 242/588.2, 588.3, 588.6; 206/411
See application file for complete search history.

(56) References Cited

U.S. PATENT DOCUMENTS 3,774,309 A 11/1973 Leopoldi
4,315,047 A 2/1982 Seabold et al.
4,341,585 A 7/1982 Seabold et al.
4,591,407 A 5/1986 Samuelson
4,748,746 A 6/1988 Jacoff
4,851,076 A 7/1989 Manusch et al.
4,853,074 A 8/1989 Manusch
5,210,956 A 5/1993 Knispel et al.
5,393,368 A * 2/1995 Stevens ..... 156/577
5,430,904 A 7/1995 Ono et al.

(Continued)

FOREIGN PATENT DOCUMENTS

DE 102 14 604 A1 10/2003
EP 0267396 B2 9/1987
EP 1 295 834 A1 3/2003

OTHER PUBLICATIONS

International Search Report for International Application No. PCT/US2004/020055 dated Nov. 5, 2004.
Written Opinion for International Application No. PCT/US2004/20055 dated Nov. 5, 2004.

(Continued)

*Primary Examiner*—Mark A Osele
(74) *Attorney, Agent, or Firm*—Marshall, Gerstein & Borun LLP

(57) ABSTRACT

A transfer tape dispenser comprises a housing and a supply spool and a take up spool disposed within the housing. A carrier ribbon has a first end and a second end, with the first end connected to the supply spool, and the second end connected to the take-up spool. An applicator tip is partially disposed within the housing and includes a platform with a front edge, a rear edge, a first side edge, a second side edge, a top surface, a bottom surface. A first wall is adjacent to the first side edge and a second wall is adjacent to the second side edge. At least one protuberance extends from the applicator tip and is adapted to maintain outer edges of the transfer tape adjacent to the top surface of the platform.

22 Claims, 14 Drawing Sheets

U.S. PATENT DOCUMENTS

| | | | |
|---|---|---|---|
| 5,490,898 | A | 2/1996 | Koyama |
| 5,679,156 | A | 10/1997 | Matsumaru |
| 5,795,085 | A | 8/1998 | Yoo |
| 5,899,619 | A | 5/1999 | O'Shei |
| 6,145,770 | A | 11/2000 | Manusch et al. |
| 6,148,534 | A | 11/2000 | Li |
| 6,270,578 | B1 | 8/2001 | Murakoshi |
| 6,273,162 | B1 | 8/2001 | Ohara et al. |
| 6,273,169 | B1 | 8/2001 | Ono et al. |
| 6,321,815 | B1 | 11/2001 | You |
| 6,321,816 | B1 | 11/2001 | Koreska |
| 6,324,769 | B1 | 12/2001 | Murray |
| 6,363,990 | B1 | 4/2002 | Kozaki |
| 6,435,248 | B1 | 8/2002 | Masumoto |
| 6,450,231 | B1 | 9/2002 | Ishikawa |
| 6,461,068 | B1 | 10/2002 | Holmes |
| 6,601,631 | B1 | 8/2003 | Miller et al. |
| 6,729,377 | B2 | 5/2004 | Huthmacher |
| D491,986 | S | 6/2004 | Bain |
| 6,874,554 | B2 | 4/2005 | Chandaria |
| 2003/0066612 | A1 | 4/2003 | Herrmannsen et al. |
| 2004/0011473 | A1 * | 1/2004 | Van Tyle et al. ..... 156/527 |

OTHER PUBLICATIONS

*International Preliminary Examination Report* corresponding to International Patent Application Serial No. PCT/US2004/020055, European Patent Office, dated Dec. 21, 2005, 14 pages.

European Search Report for Application No.07015989.2-2314, dated Jan. 2, 2008.

* cited by examiner

CORRECTION TAPE APPLICATOR TIP WITH CYLINDRICAL PROJECTION

FIELD OF THE DISCLOSURE

The present disclosure relates to a transfer tape dispenser, and more particularly to an applicator tip with a protuberance for use in a transfer tape dispenser.

BACKGROUND OF THE DISCLOSURE

Transfer tape dispensers are typically used to apply an application layer of material to a surface from a flexible carrier tape. The dispensers typically include an applicator tip that receives the carrier tape coated on one side with the application layer from a supply spool and apply the application layer to a surface. A return spool then collects the carrier tape.

The applicator tip includes a platform across which the carrier tape traverses. Tape guides typically extend perpendicularly from the platform of the applicator tip. The tape guides maintain the carrier tape on the platform of the applicator tip while the dispenser is in use by not allowing the carrier tape to slip off the side of the platform.

The application layer can consist of one or more layers of material. When the application layer is pressed against a surface by the applicator tip, it is released from the carrier tape and transferred to the surface. A correction application layer consists of an opaque layer to obscure a mark and a contact adhesive layer to attach the opaque layer to a surface.

In certain circumstances, it has been found that the carrier tape may fold over itself along its length. While the tape guides are effective for maintaining the carrier ribbon on the platform, they have no effect in ensuring that the carrier tape does not fold over itself. This is especially a problem when the user must follow a curving or twisting path to cover a mark. It can also be a problem in certain designs of transfer tape dispensers in which the carrier tape must rotate 90° along its length after leaving the supply spool but before traversing the applicator tip.

Figures 1, 7:
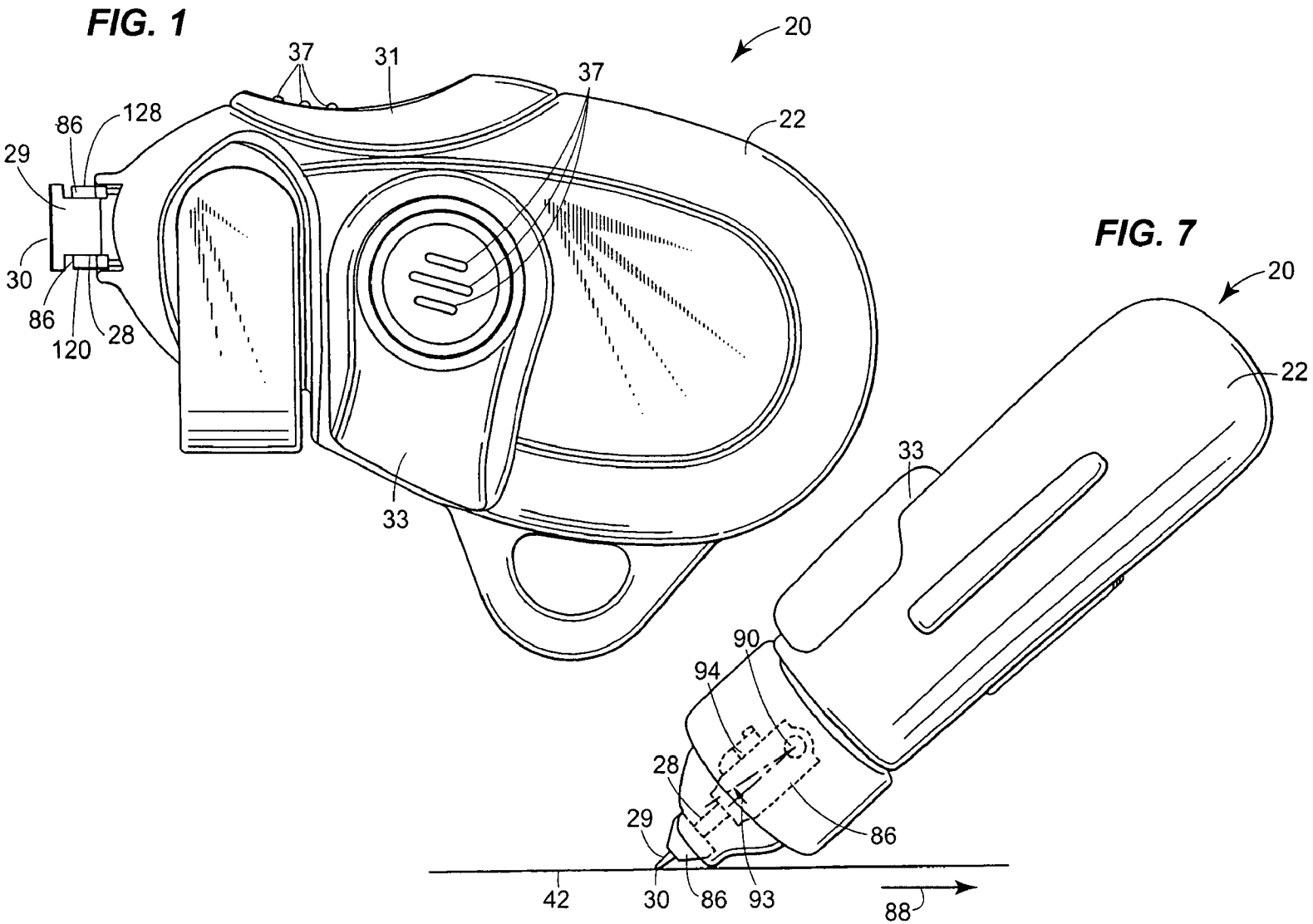
FIG. 1 is a side elevational view of an example of a transfer tape dispenser constructed in accordance with the teachings of the present disclosure.
FIG. 7 is a bottom elevational view of the transfer tape dispenser of FIG. 1.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and the equivalents falling within the spirit and scope of the invention as defined by the appended claims.

DETAILED DESCRIPTION

Referring to FIGS. 1-8, a transfer tape dispenser 20 in accordance with the teachings of the present disclosure is generally shown. The transfer tape dispenser 20 includes a case 22, a supply spool 24, a return spool 26, and an applicator tip 28 having an application edge 30. The transfer tape dispenser 20 also includes a correction tape 32 having an application layer (not shown) and a carrier tape (not shown). A path of travel of the transfer tape 32 in the transfer tape dispenser 20 originates with the supply spool 24 and terminates with the return spool 26. A tape post 38 directs the transfer tape 32 from the supply spool 24 to the applicator tip 28, and from the applicator tip 28 to the return spool 26, respectively. When pressing the application edge 30 on a surface 42 (as shown in FIG. 7), the application layer (not shown) adheres to the surface 42 to mask a portion of the surface 42 to which it is applied. Subsequently, the carrier tape (not shown) is collected by the return spool 26. The transfer tape dispenser 20 includes, in this example, a cushion body 94 that cushions the pressing of the application edge 30 on the surface 42. The transfer tape dispenser 20 further includes, in this example, a slip clutch mechanism 46 for providing slipping of the supply spool 24 relative to the rotation of the return spool 26, when necessary, to avoid the buildup of excessive tension in the transfer tape 32.

One of ordinary skill in the art will readily appreciate that the application layer (not shown) of the transfer tape 32 can provide numerous functions. For example, the application layer (not shown) can be an adhesive material, a highlighting material, or a decorative coating material. Accordingly, one side of the application layer (not shown) can adhere to the surface 42, while the other side of the application layer (not shown) can provide a different functionality. In the disclosed example, however, the application layer (not shown) is a correction tape layer and is referred to as such. The correction tape layer (not shown) can be applied to a surface 42 to mask a portion of the surface 42 to which it is applied. The correction tape layer (not shown) is applied to one side of a carrier tape. The carrier tape consists of a flexible ribbon or strip of plastic or paper.

Figure 2:
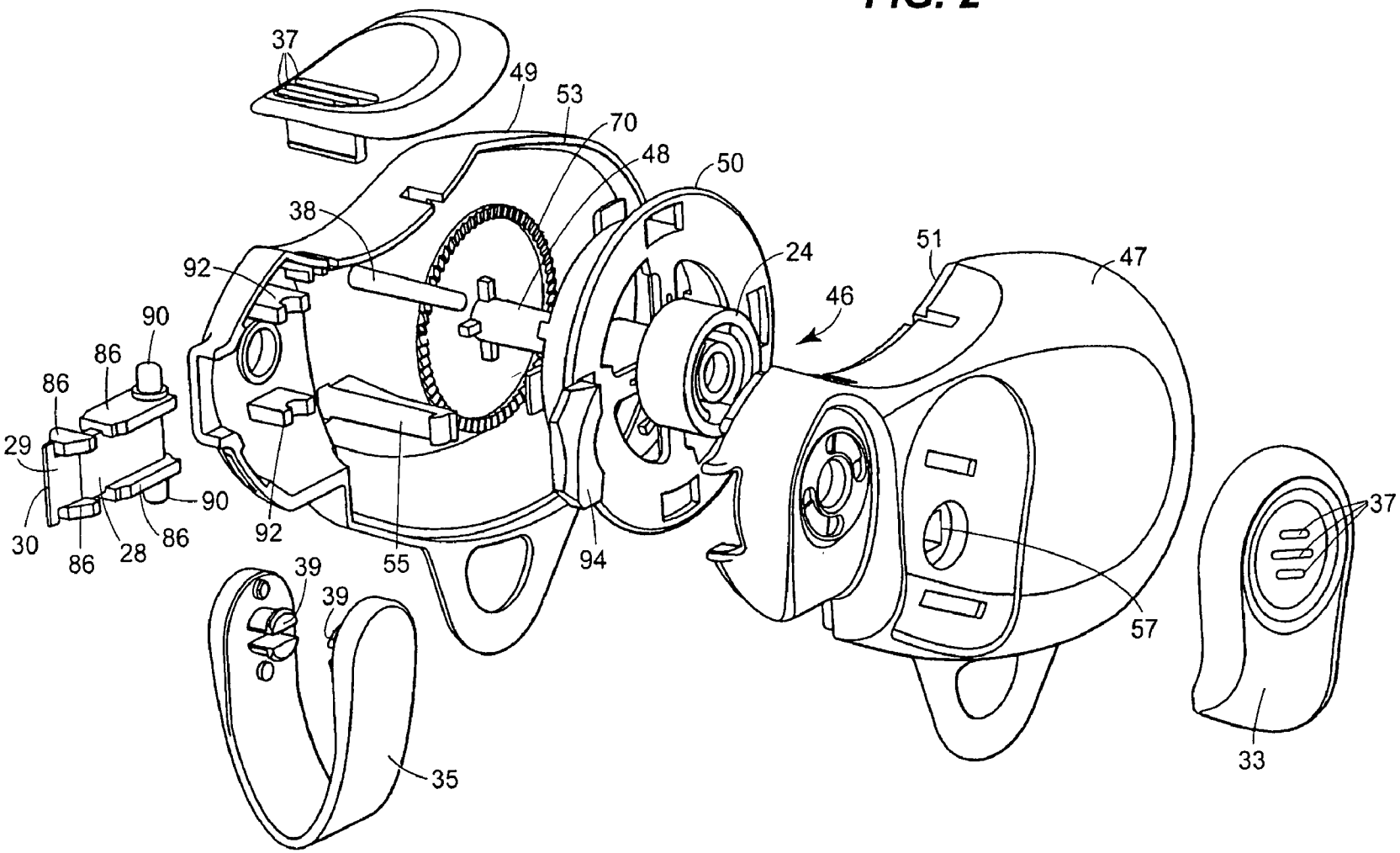
FIG. 2 is an exploded isometric view of the transfer tape dispenser of FIG. 1.

Referring to FIG. 2, the case 22 includes a first side 47 and a second side 49 that are attached together to house various components of the transfer tape dispenser 20. In the disclosed example, the two housings 47 and 49 of the case 22 are detachably attached together by a tongue 51 on the first side 47 that engages a groove 53 on the second side 49. To secure the two housings 47 and 49 together, the second side 49 includes a locking tab 55 that engages a corresponding aperture 57 in the first side 47. The case 22 can be shaped as desired. However, in the disclosed example, the case 22 is ergonomically shaped to provide comfort and intuitive operation when being operated by a user.

Referring to FIGS. 1 and 2, the transfer tape dispenser 20 includes an index finger grip pad 31, a thumb grip pad 33, and an applicator tip cover 35 that is pivotally attached to the case 22. The index finger grip pad 31 is disposed on the upper part of the case 22 where a user would typically place his index finger when using the transfer tape dispenser 20. The grip pads 31 and 33 may either be part of the case 22 and constructed from the same material, or be independent grip pads of the same as or a different material that are attached to or formed on the case 22. In the disclosed example, the grip pads 31 and 33 are constructed from an elastomer and are attached to the case 22. Additionally, to provide sufficient grip between a user's finger and the grip pads 31 and 33 when holding the transfer tape dispenser 20, both grip pads 31 and 33 may be constructed from a soft plastic and may include a number of ridges 37 on their respective surfaces.

The application tip cover 35 can be employed to protect the applicator tip 28 when not in use. Referring to FIG. 2, the applicator tip cover 35 is generally shaped to correspond with the lateral cross sectional profile of the case 22. Each end 39 of the applicator tip cover 35 is pivotally attached to one of the first side 47 or the second side 49 of the case 22. Accordingly, the applicator tip cover 35 rotates about an axis (not shown) passing through the ends 39. When the transfer tape dispenser 20 is being used, the applicator tip cover 35 can be pivoted or rotated to the open position, as shown in FIG. 1. When the transfer tape dispenser 20 is no longer being used, a user can rotate the applicator tip cover 35 in a direction 41 to a closed position (not shown) covering the tip 28. The applicator tip cover 35, if employed, guards the applicator tip 28 and the application edge 30, and prevents external objects from coming into contact with the applicator tip 28, the application edge 30, and the transfer tape 32. One of ordinary skill in the art will readily appreciate that the applicator tip 28 can be covered by a wide variety of covers. For example, the transfer tape dispenser 20 can include a cap (not shown) that is shaped similar to the portion of the case 22 where the applicator tip 28 is disposed. A user can place the cap on the corresponding portion of the case 22 to cover the applicator tip 22.

The case 22 includes a shaft 48 for mounting a drive wheel 50 inside the case 22. The drive wheel 50 includes a central hub 52 for being rotationally mounted on the shaft 48. The shaft 48 extends laterally and, in this example, from the second side 49 to first side 47. Accordingly, the drive wheel 50 can freely rotate about the shaft 48, but is prevented from moving or rotating in any other direction. The supply spool 24 is rotationally mounted on a supply side 58 of the drive wheel 50, and as will described in detail below can rotate with the drive wheel 50 or slip relative to the drive wheel 50 when necessary. The return spool 26 is disposed on a return side 60 of the drive wheel 50. In the disclosed example, the return spool 26 is an integral part of the drive wheel 50 and, therefore, rotates with the drive wheel 50. In the disclosed example, the return spool 26 is a circular ledge 62 that is integral with and protrudes outwardly from the return side 60 of the drive wheel 50. The circular ledge 62 is concentric with the drive wheel 50 and has a wider width than the width of the transfer tape 32. Accordingly, the circular ledge 62 defines the return spool 26 for collecting the carrier tape (not shown) of the transfer tape 32 in a winding manner, hence the return spool 26. To prevent the transfer tape 32 from sliding off the circular ledge 62 when being wound thereon, a plurality of side walls 64 are provided around the circular ledge 62 to contain the transfer tape 32 on the return spool 26.

To dispense the transfer tape 32 from the supply spool 24, the drive wheel 50 rotates in a dispensing direction 66 to unwind the transfer tape 32 from the supply spool 24. Additionally, the carrier tape (not shown) is collected on the return spool 26 by being wound thereon when the drive wheel 50 rotates in the dispensing direction 66. Accordingly, the transfer tape 32 is dispensed by unwinding from the top of the supply spool 24 and is collected by being wound on the return spool 26 from the bottom thereof. One of ordinary skill in the art will appreciate, however, that the aforementioned winding and unwinding configuration of the transfer tape 32 can be reversed to achieve the same result.

Figure 4:
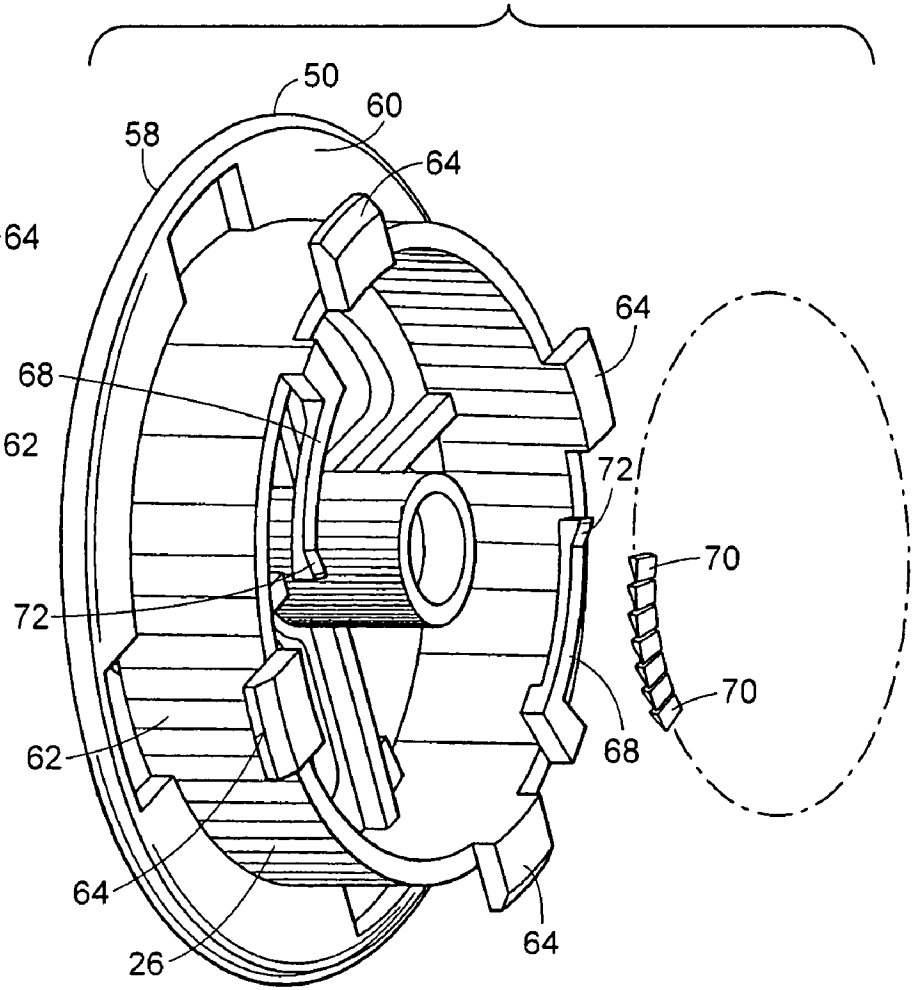
FIG. 4 is an isometric view from the opposite side of the drive wheel of FIG. 3.

To prevent the wheel 50 from rotating in a non-dispensing direction (i.e., opposite the dispensing direction 66), the drive wheel 50 includes a number of flexible tabs 68 radially disposed on the return side 26 of the drive wheel 50 that engage a number of detents 70 radially disposed on the interior of the second side 49. As shown in FIG. 4, the flexible tabs 68 include wedge shaped tips 72 that engage the detents 70, which are also wedge shaped. In the dispensing direction 66, the angled face of each wedge shaped tip 72 engages the angled face of a detent 70. Accordingly, the flexibility of the flexible tabs 68 causes the angled faces of the wedge shaped tips 72 of the flexible tabs 68 to slide over the detents 70 to allow rotation of the drive wheel 50 in the dispensing direction 66. In contrast, when the drive wheel 50 is rotated in the non-dispensing direction, the vertical face of each wedge shaped tip 72 engages the vertical face of a detent 70 to prevent the wheel 50 from rotating in the non-dispensing direction.

As the transfer tape 32 is unwound from the supply spool 24 and wound on the return spool 26, the diameter of the supply spool 24, including the supply of transfer tape 32, shrinks and the diameter of the return spool, including the supply of carrier tape (not shown), grows. Because the two spools 24, 26 generally rotate in unison, the changing diameter would cause tension in the transfer tape 32 to change. The slip clutch mechanism 46 maintains a maximum desired tension in the transfer tape 32 as the diameters of the supply spool 24 and the return spool 26 change.

Figure 3:
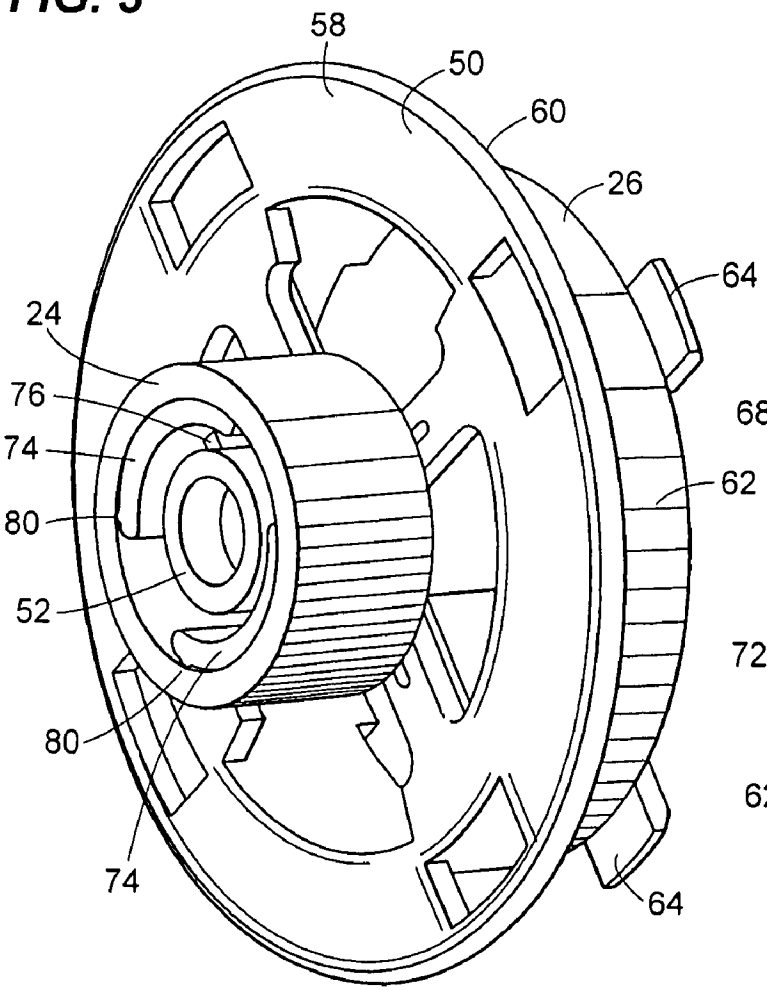
FIG. 3 is an isometric view of a drive wheel of the transfer tape dispenser of FIG. 1.
Figure 5:
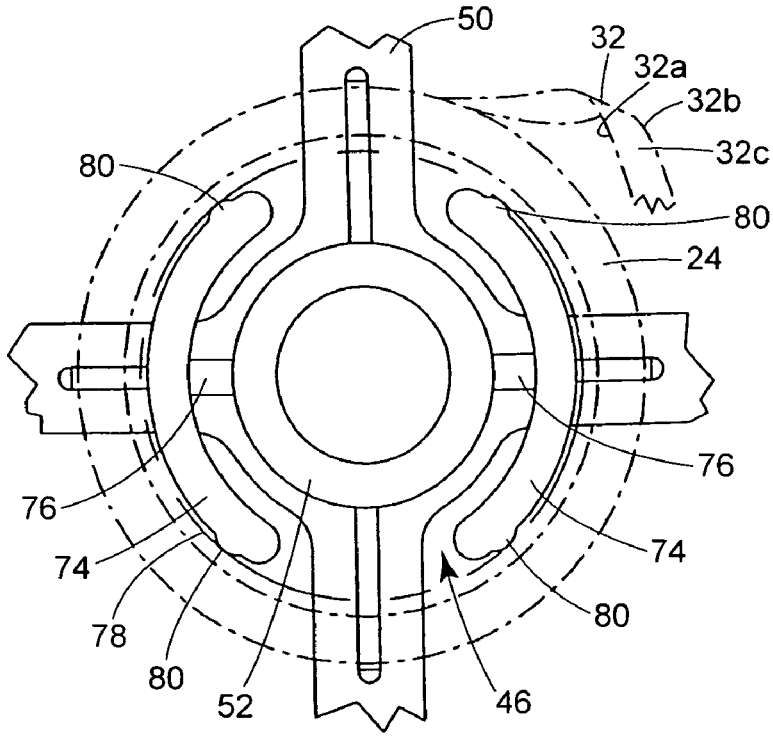
FIG. 5 is a side elevational view of a slip clutch mechanism of the transfer tape dispenser of FIG. 1.

As shown in FIGS. 3 and 5, the slip clutch mechanism 46 includes a pair of arcuate shoes 74 that have an outside diameter of generally similar size as the internal diameter of the supply spool 24. Each arcuate shoe 74 is attached to the hub 52 on the supply side 58 of the drive wheel 50 with a spoke 76. In effect, the arcuate shoes 74 partially define a supply hub 78 (shown with dashed lines), which is concentric with the hub 52, for mounting the supply spool 24 on the supply side 58 of the drive wheel 50. Each arcuate shoe 74 includes a pair of ridges 80 that extend across its width. The ridges 80 slightly protrude radially outward from the supply hub 78. Furthermore, the ridges 80 are distributed relative to the supply hub 78 in an evenly spaced radial manner. Accordingly, when the supply spool 24 is mounted on the supply hub 78, the ridges 80 cause the arcuate shoes 74 to flex and bias the ridges 80 against the internal periphery of the supply spool 24 to maintain frictional contact with the internal periphery of the supply spool 24

When the diameter of the return spool 26 is larger than the diameter of the supply spool 24, the transfer tape 32 needs to unwind faster from the supply spool 24 than the speed by which is being wound on the return spool 26. The tension of the transfer tape 32 needs to be sufficient to overcome the frictional forces between the ridges 80 and the internal periphery of the supply spool 24 to provide faster rotation of the supply spool 24 relative to the drive wheel 50. Thus, the supply spool 24 must slip on the arcuate shoes 74 when necessary to synchronize the length of tape unwound from the supply spool 24 with the length of the tape wound on the return spool 26.

When the diameter of the return spool 26 is smaller than the diameter of the supply spool 24, the transfer tape 32 needs to unwind slower from the supply spool 24 than the speed by which is being wound on the return spool 26. The tension of the transfer tape 32 needs to be sufficient to overcome the frictional forces between the ridges 80 and the internal periphery of the supply spool 24 to provide slower rotation of the supply spool 24 relative to the drive wheel 50. Thus, the supply spool 24 must slip on the arcuate shoes 74 when necessary to synchronize the length of tape unwound from the supply spool 24 with the length of the tape wound on the return spool 26.

One of ordinary skill in the art will appreciate that the slip clutch mechanism operates by providing a slippable engagement between the drive wheel 50 and the supply spool 24. Accordingly, a variety of well known slip clutch mechanisms can be utilized for the transfer tape dispenser 20. For example, a gasket, an o-ring, or a washer (not shown) that is constructed from a flexible material can be disposed on the hub 52 to frictionally engage the internal periphery of the supply spool 24. In yet another example, the hub 52 can include a plurality of detents (not shown) radially disposed thereon that can engage a plurality of detents (not shown) on the internal periphery of the supply spool 24.

Figure 6:
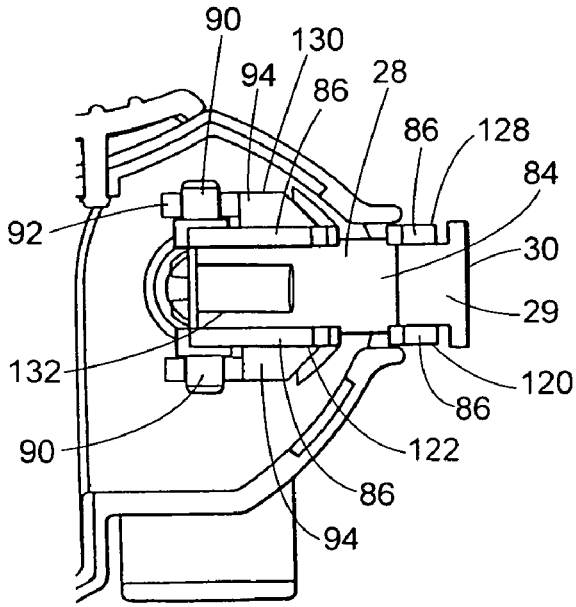
FIG. 6 is a fragmentary view of a portion of the transfer tape dispenser.
Figure 8:
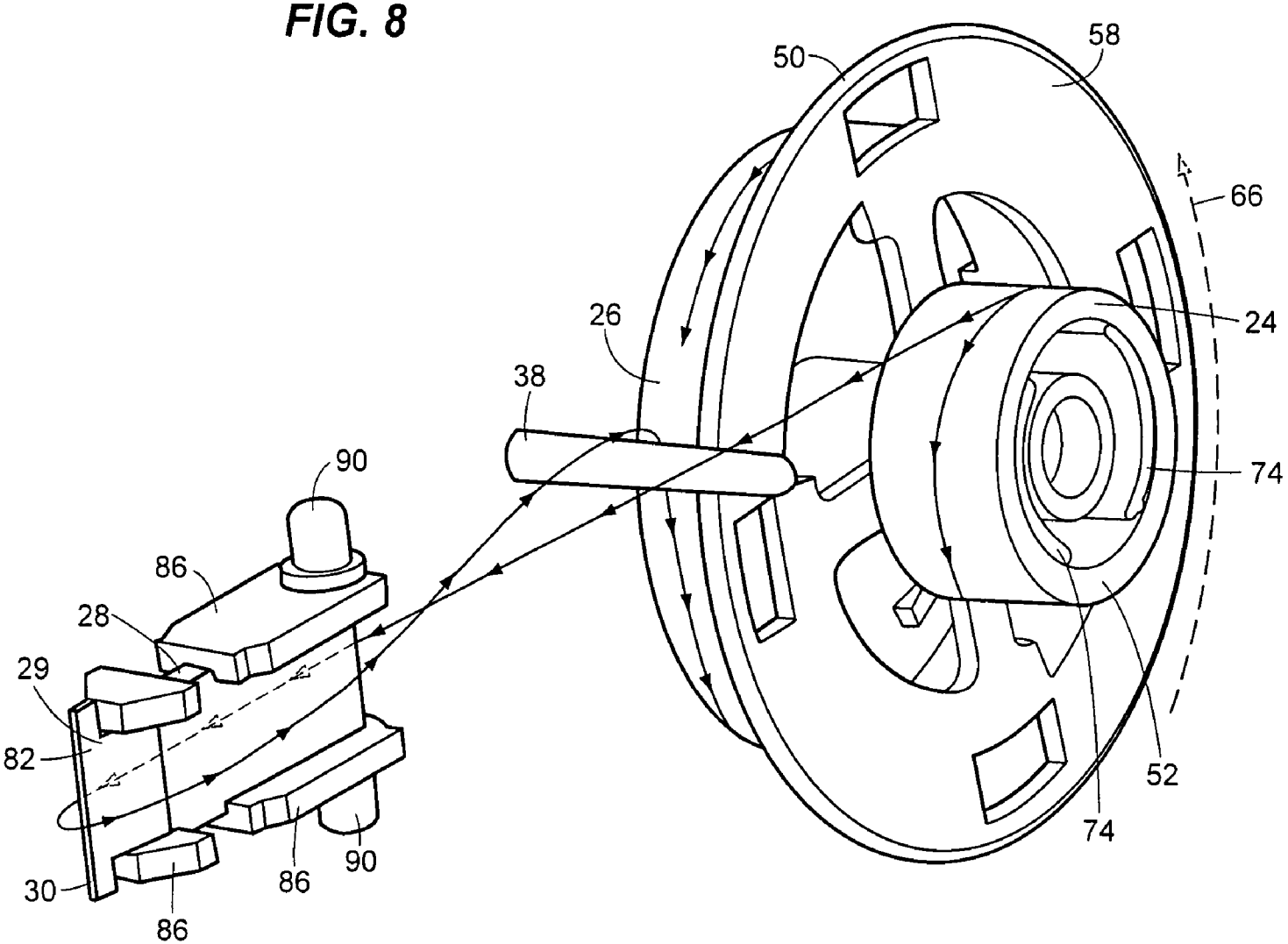
FIG. 8 is an isometric view of the transfer tape dispenser of FIG. 1 and showing the tape path.

Referring to FIGS. 6 and 8, the applicator tip 28 is pivotally mounted inside the case 22. A portion 29 of the applicator tip 28, which includes the application edge 30, protrudes from the case 22 so that the tape 32 can be applied to a surface 42. The protruding portion 29 of the applicator tip 28, however, is wedge-shaped to guide the transfer tape 32 to and from the application edge 30. The transfer tape 32 travels from the supply spool 24 to reach an application side 84 of the applicator tip 28, travels around the application edge 30, and departs a non-application side 82 of the applicator tip 28 for the return spool 26. To maintain the transfer tape 32 on both the application side 84 and the no-application side 82 while traveling on the applicator tip 28, the applicator tip 28 can include guides 86 attached to the sides and bounding the width thereof. The guides 86 can also serve to guide the transfer tape 32 and the carrier tape (not shown) to and from the application edge 30, respectively.

As shown in FIG. 8, the disclosed applicator tip 28 is generally oriented near 90° relative to the orientation of the transfer tape 32 as it is unwound from the supply spool 24. Accordingly, in this example, the tape post 38 directs the transfer tape 32 from the supply spool 24 to the applicator tip 28, and also twists the transfer tape 32 to change its orientation in the path between the supply spool 24 and the applicator tip 28. Also, the tape post 38 directs the transfer tape 32 from the applicator tip 28 to the return spool 26, and also twists the carrier tape (not shown) to change its orientation in the tape path between the applicator tip 28 and the return spool 26. One of ordinary skill in the art will appreciate that the supply tape post 38 can take on a variety of shapes and sizes in order to perform the described functions. In the disclosed example, however, the tape post 38 is a cylindrical rod that is mounted in the case and is generally parallel with the shaft 48.

Referring to FIG. 7, the transfer tape 32 is applied to a surface 42 by a user pressing the application side 84 of the application edge 30 on the surface 42 and moving the transfer tape dispenser 20 in a direction 88. The contact of the transfer tape 32 with the surface 42 at the application edge 30, combined with the movement of the transfer tape dispenser 20 in the direction 88, causes the transfer tape 32 to be pulled from the supply spool 24. Meanwhile, the contact of the application edge 30 with the surface 42 causes the correction tape layer (not shown) of the transfer tape 32 to adhere to the surface 42 at the application edge 30. Because the return spool 26 rotates with the drive wheel 50, the carrier tape (not shown) is pulled by the return spool 26 and collected windingly thereon. Thus, moving the transfer tape dispenser 20 in the direction 88 applies the correction tape layer (not shown) and masks a portion of the surface 42 along the direction 88.

The applicator tip 28 includes a pivot shaft 90 that is pivotally mounted in the case 22 to provide pivoting of the applicator tip 28 at the application edge 30 when being applied to a surface 42. The pivot shaft 90 is parallel with the application edge 30 and is pivotally mounted in a pair of forks 92 that protrude from the case 22. Accordingly, each end of the pivot shaft 90 pivots inside a corresponding fork 92 to provide pivoting of the applicator tip 28.

The pivoting of the applicator tip 28 is limited and cushioned, in this example, by a cushion body 94 disposed between the applicator tip 28 and the first side 47 of the case 22. When the application edge 30 is pressed on a surface 42, the applicator tip 28 pivots in a direction 93 as shown in FIG. 7. When the applicator tip 28 pivots from a rest position the guides 86 of the applicator tip 28 contact the cushion body 94, thus allowing the carrier tape to pass between the cushion body 94 and the non-application side 82 of the applicator tip 28. The pivoting of the applicator tip 28 from a rest position to an application position against the cushion body 94 causes the guides 86 to compresses the cushion body 94, which in turn reacts with a force that biases the applicator tip 28 back to the rest position. As the pivoting increases, the cushion body 94 is compressed further, which causes the force in the cushion 94 to also increase. Accordingly, a user can intuitively sense and determine how hard the application edge 30 can be pressed on a surface 42 for uniform application of the correction tape layer (not shown).

The cushion body 94 also can provide cushioned pivoting of the applicator tip 28 when the application edge 30 is being applied to an uneven surface. Furthermore, the cushioned pivoting of the applicator tip 28 can compensate for any misalignment between the application edge 30 and a surface 42. One of ordinary skill in the art will readily appreciate that the cushion body 94 may operate like a spring, a dampener or both. The cushion body 94, in this example, is a resilient body that when pressed in a direction provides a reaction force in an opposite direction.

Figure 9:
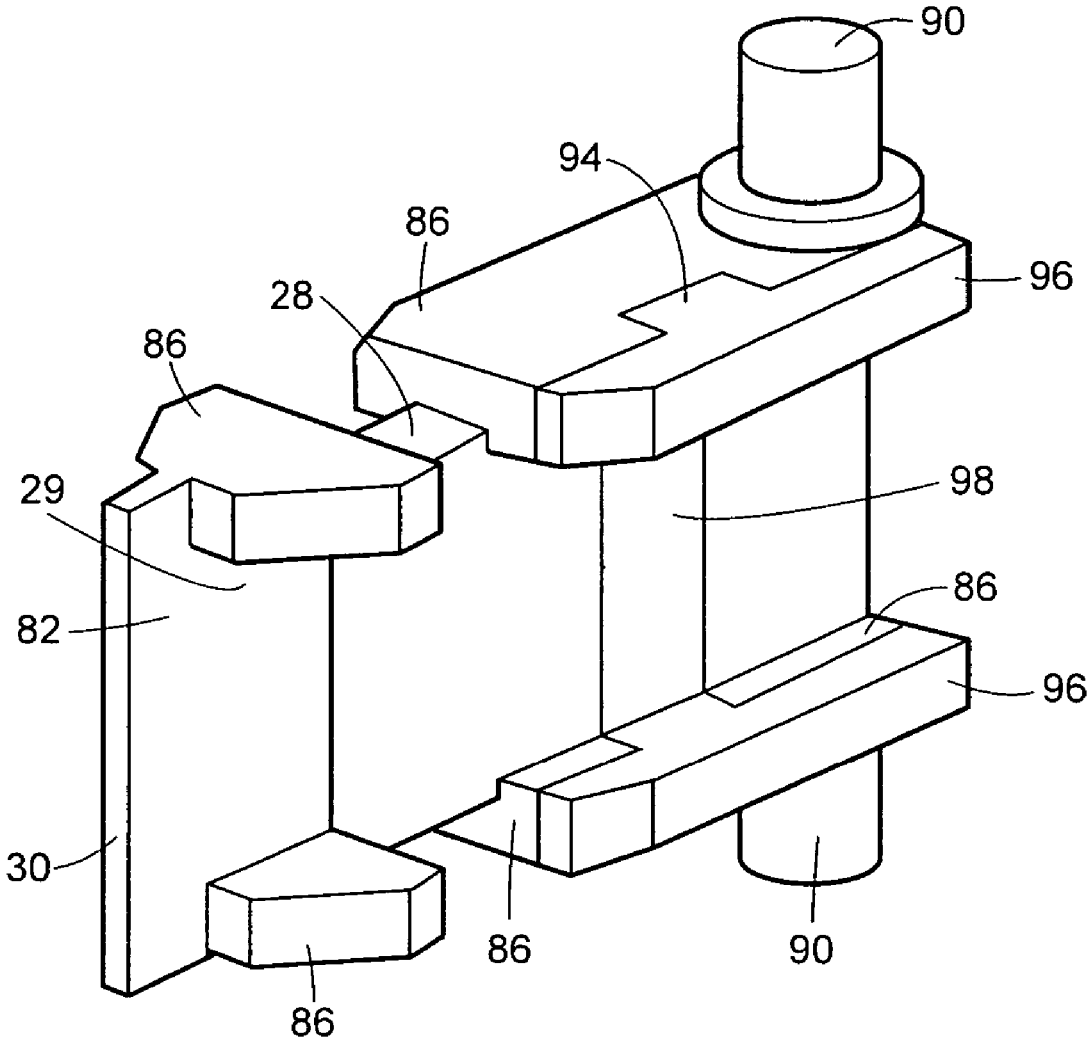
FIG. 9 is an isometric view of an alternate example an applicator tip and a cushion body for a transfer tape dispenser constructed in accordance with the teachings of the present disclosure.

Referring to FIG. 9, the cushion body 94 and the applicator tip 28 can be co-molded during manufacturing. Accordingly, the cushion body 94 is in one piece and includes a pair of cushion body sides 96 that are co-molded on the guides 86 and connected by a bridge 98. When co-molding the cushion body 94 with the applicator tip 28, the bridge 98 fits in a correspondingly sized indentation on the non-application side 82 of the applicator tip 28 so as to be positioned flush with the non-application side 82.

The cushion body 94 may be connected to the applicator tip 28 by, for example, being co-molded with the applicator tip 28, as described above. The cushion body 94 may also be a discrete cushion body that is disposed between the applicator tip 28 and the case 22 without being connected to either the applicator tip 28 or the case 22. The cushion body 94 may also be connected to the case 22 without being connected to the applicator tip 28. However, the cushion body 94, in this example, is constructed from a different material than the applicator tip 28 and the case 22. In the disclosed example, the cushion body 94 is constructed as a one-piece elastomer body. The cushion body 94 is also shaped to fit between the applicator tip 28 and the case 22. Furthermore, one of ordinary skill in the art will appreciate that the cushion body 94 and the applicator tip 28 can be co manufactured by, for example, an injection molding process. Similarly, the cushion body 94 and the first side 47 of the case 22 can be co manufactured by, for example, an injection molding process.

Figure 10:
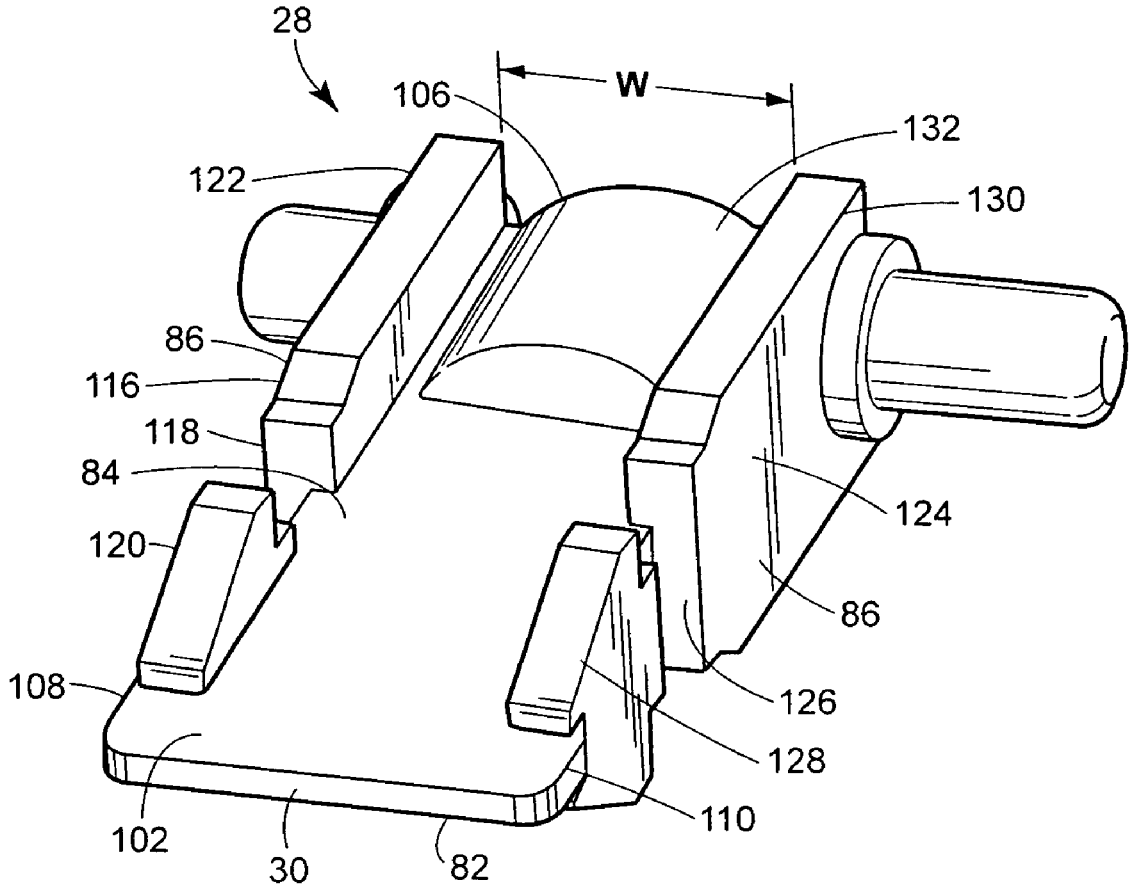
FIG. 10 is an enlarged perspective view of the applicator tip of the transfer tape dispenser with structure to protect against the carrier tape folding over itself.
Figure 11:
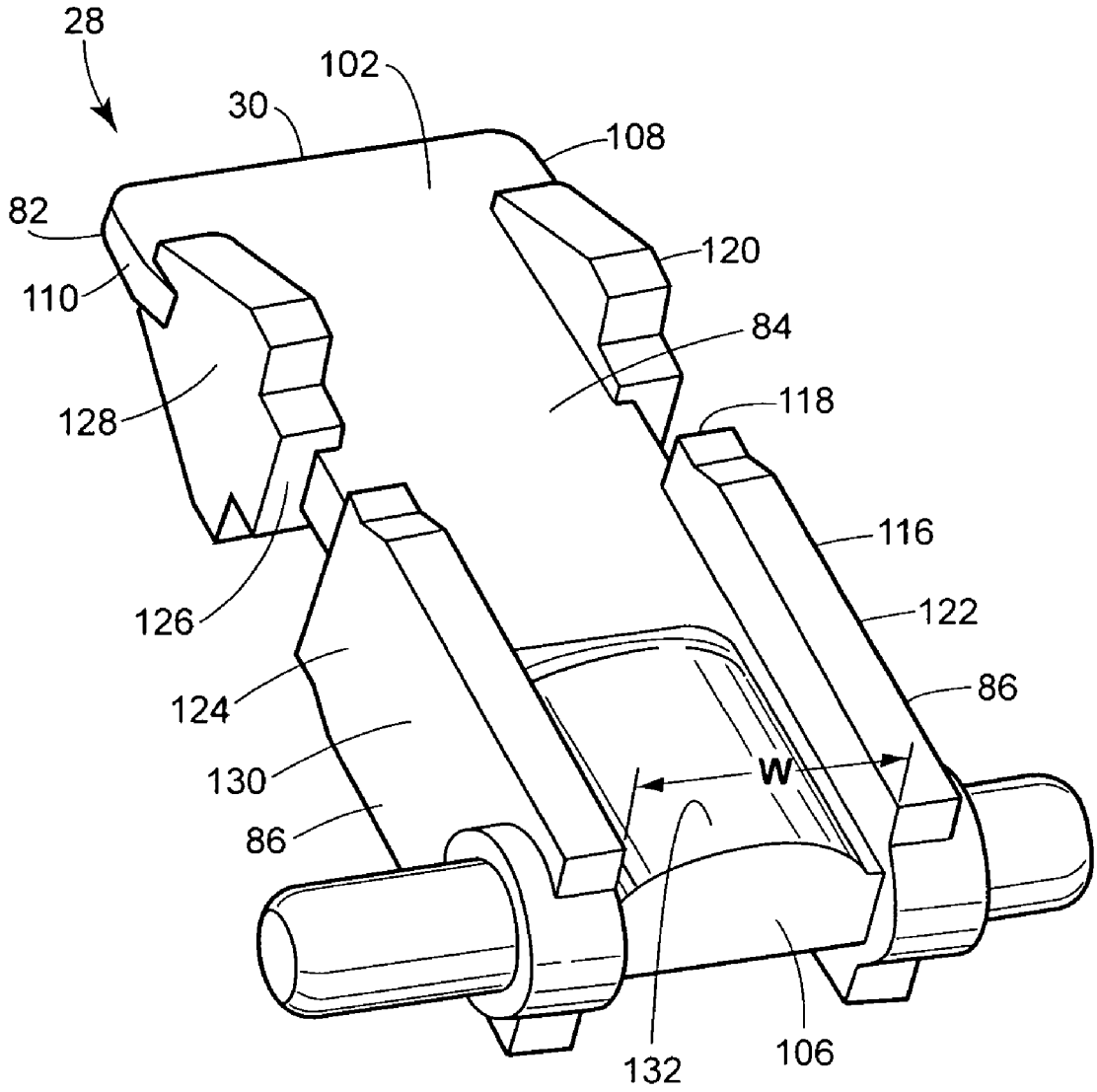
FIG. 11 is a second perspective view of the applicator tip of FIG. 10.

Referring now to FIGS. 10 and 11, the applicator tip 28 particularly suited for use with the transfer tape dispenser 20 is disclosed. The applicator tip 28 includes a platform 102 that defines the application edge 30, a back edge 106, a left edge 108, a right edge 110, the application side 84 and the non-application side 82. Adjacent the left edge 108 is a first side wall 116. The first side wall 116 includes a groove 118 that divides the first side wall 116 into a forward portion 120 and a rear portion 122. Adjacent the right edge 110 is a second side wall 124. The second side wall 124 also includes a groove 126 that divides the second side wall 124 into a forward portion 128 and a rear portion 130. As can be seen in FIGS. 1 and 6, the respective forward portions 120, 128 can extend out from inside the case 22, and the respective rear portions 122, 130 can be disposed inside the case 22. The tape guides 86 described earlier are comprised of the first side wall 116 and the second side wall 124.

In this example, the application side 84 is the supply side surface, and the non-application side 82 is the retune side surface. That is, the transfer tape 32 travels from the supply spool 24, over the application side 84, around the application edge 30, back across the non-application side 82, and back to the return spool 26.

Extending up from the application side 82 of the applicator tip 20 is a protuberance 132. In this example the protuberance 132 is in the shape of a portion of a cylinder. The protuberance 132 can extend up from the application surface 84 near the back edge 106. The protuberance as shown has a length approximately ⅓ of the distance between the application edge 30 and the back edge 106, and further has a width that is slightly less than the width W between the first side wall 116 and the second side wall 118. These dimensional specifications are merely examples, and other dimensions can be effective. For example, the protuberance 132 is not limited to merely being disposed near the back edge 106 of the application surface 84. It can be placed anywhere on the application side 84. Furthermore, in this example the protuberance extends up from the application side 84. The protuberance 132 may also extend up from the non-application side 82 or a protuberance 132 may extend up from both the application side 84 and the non-application side 82.

As shown in FIG. 5, the transfer tape 32 has side edges 32*a* and 32*b*, and a middle portion 32*c*. The portion of the transfer tape 32 that is disposed over the protuberance 132 substantially takes the shape of the protuberance 132 by laying on top of it. Thus, the transfer tape 32 on the application surface 84 is maintained in a convex shape as it travels over the application surface 84 to the application edge 30. In this way, the side edges 32*a* and 32*b* are maintained adjacent the application side 84 of the applicator tip 20, and the middle portion 32*c* is forced upward by the protuberance 132.

In prior designs, when the transfer tape dispenser 20 is manipulated along a curved path, the transfer tape 32 has a tendency to fold up and over about itself along its length, i.e. the side edge 32*a* may fold up and about the middle portion 32*c* and over and on top of the opposing side edge 32*b*. This tendency can be exacerbated by designs in which the axis of rotation of the supply spool 24 is perpendicular to the application edge 30 such that the transfer tape 32 must twist or rotate 90° along its length as in the transfer tape dispenser 20. The protuberance 132, in forcing the transfer tape 32 into a convex shape, ensures that the transfer tape 32 cannot fold up and over itself along its length.

Figure 12:
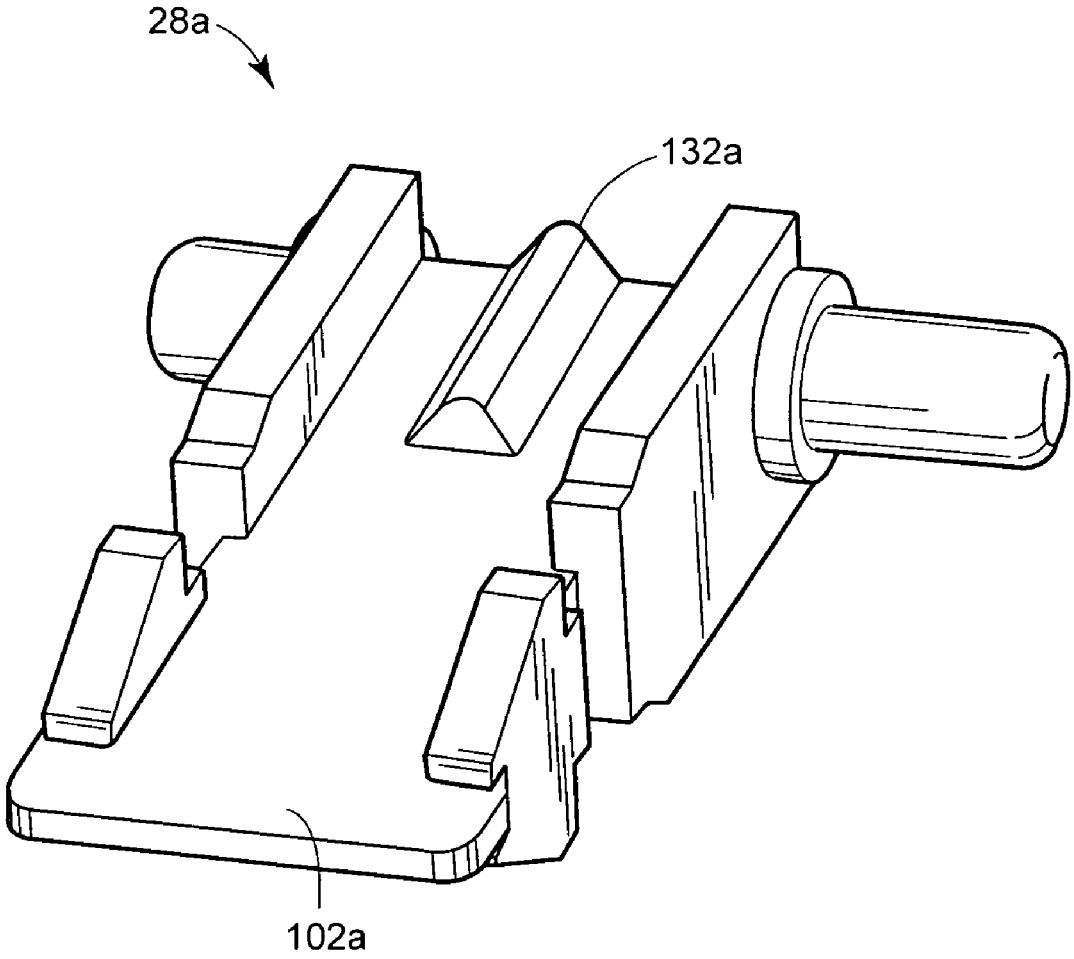
FIG. 12 is a perspective view of an alternate example of an applicator tip with structure to protect against the carrier tape folding over itself.
Figure 13:
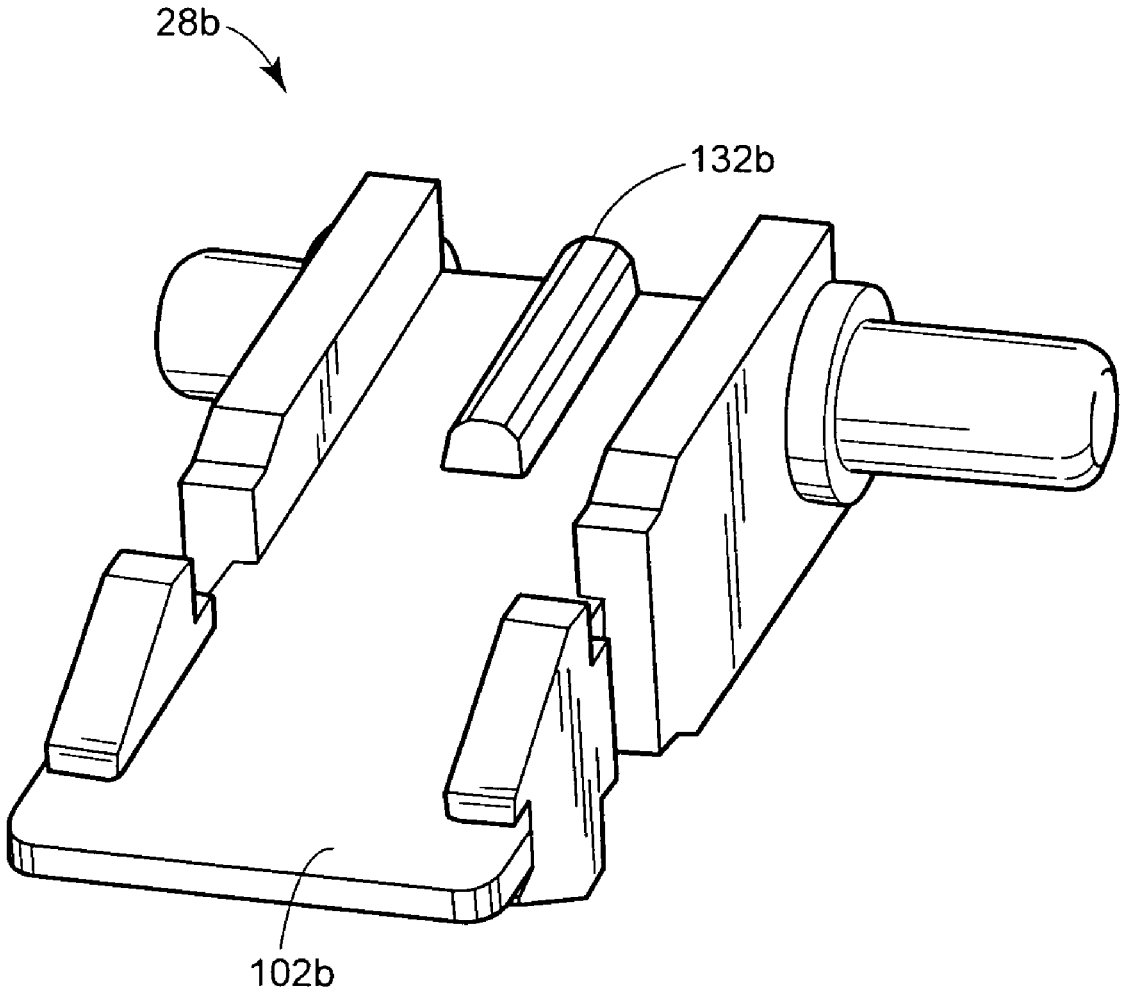
FIG. 13 is a perspective view of an alternate example of an applicator tip with structure to protect against the carrier tape folding over itself.
Figure 14:
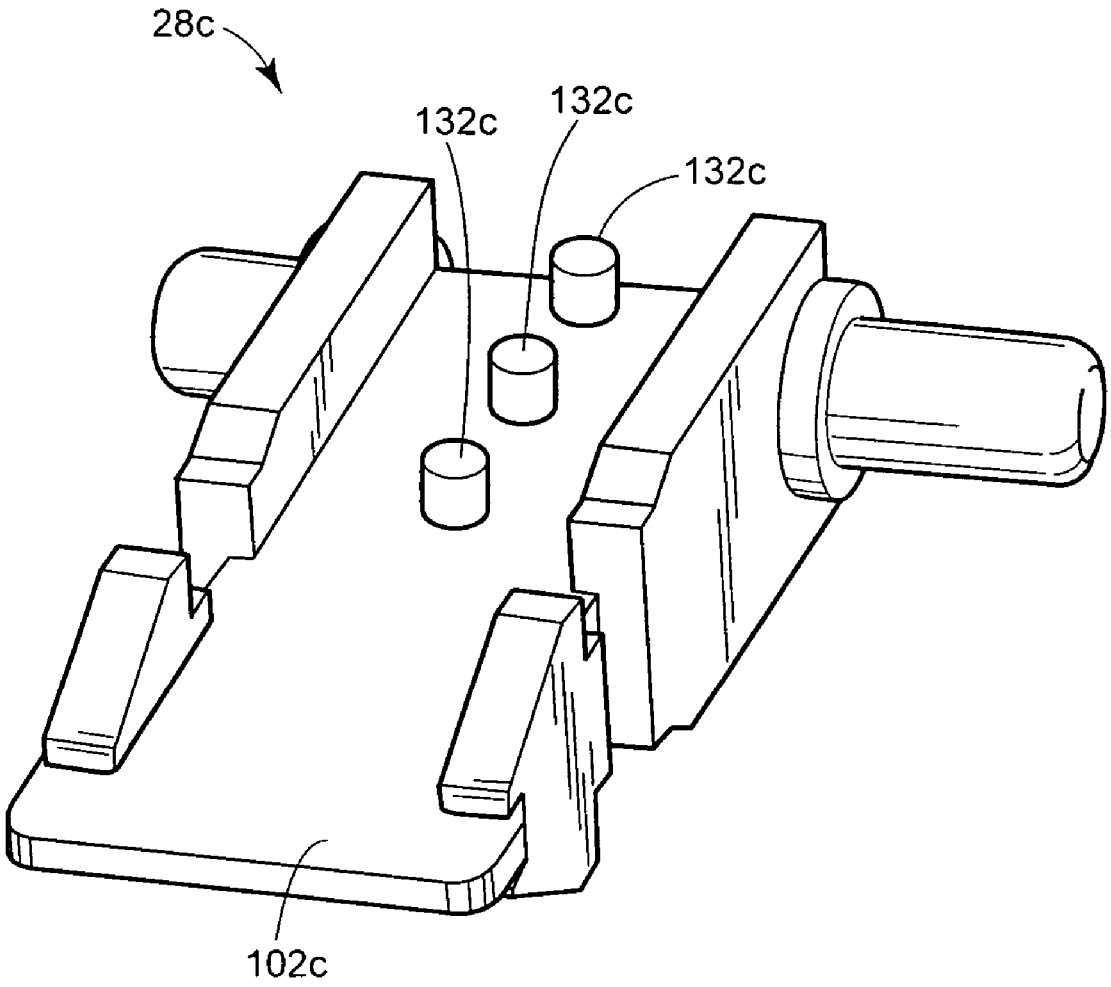
FIG. 14 is a perspective view of an alternate example of an applicator tip with structure to protect against the carrier tape folding over itself.
Figure 15:
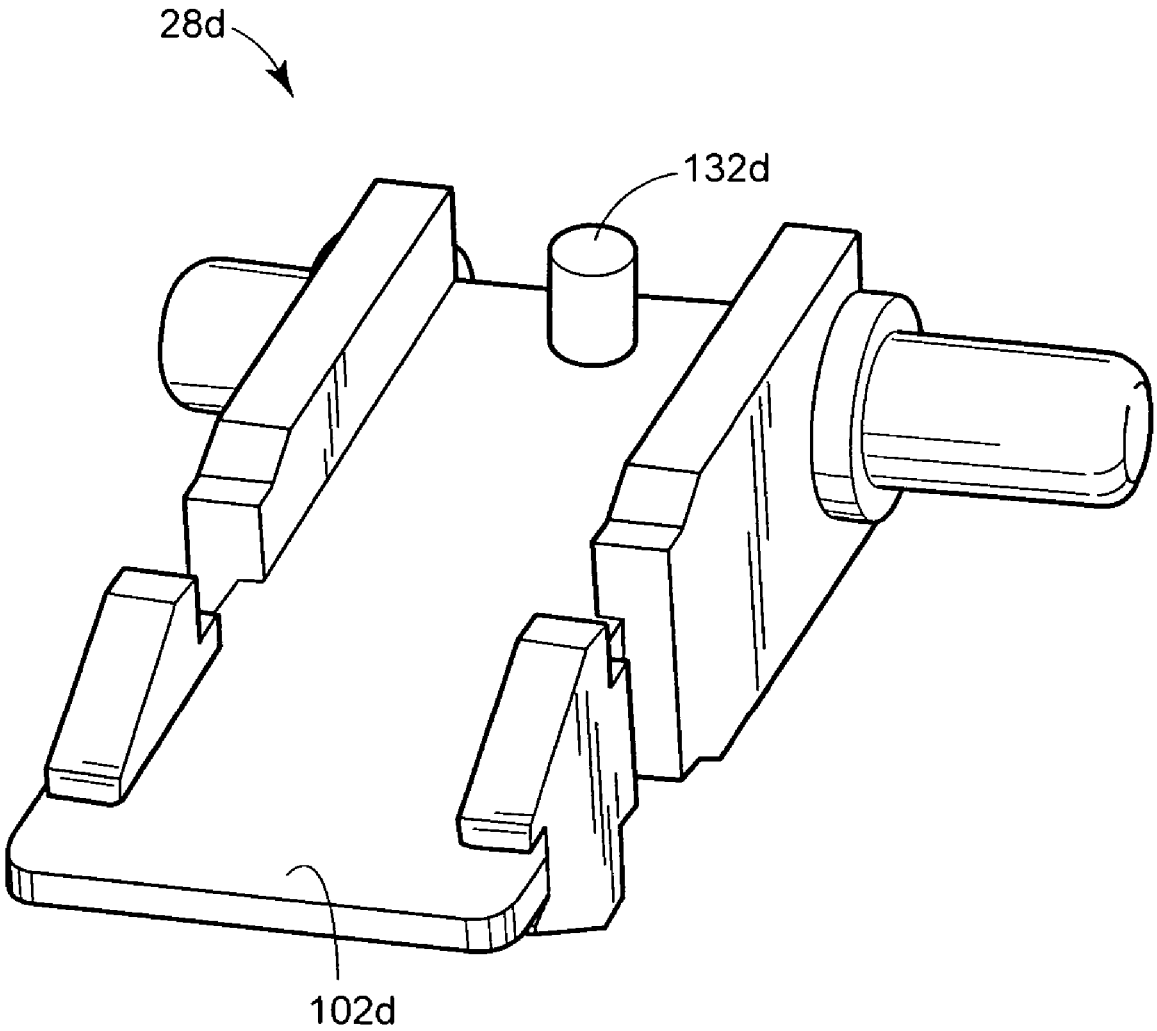
FIG. 15 is a perspective view of an alternate example of an applicator tip with structure to protect against the carrier tape folding over itself.

While the protuberance 132 here is shown as a portion of a cylinder, other shapes could be used to ensure that transfer tape 32 does not fold up and over itself. For example, FIG. 12 depicts an applicator tip 28*a* with a platform 102*a* and a protuberance 132*a* upstanding from the platform 102*a*. The protuberance 132*a* has the shape of a prism. The protuberance 132*a* can have a smoothly rounded top edge. FIG. 13 depicts an applicator 28*b* with a platform 102*b* and a protuberance 132*b* in the shape of a rail upstanding from the platform 102*b*. The protuberance 132*b* can include smoothly rounded edges adjacent the top surface. FIGS. 14 and 15 depict applicator tips 28*c* and 28*d* with platforms 102*c* and 102*d*, respectively, and protuberances 132*c* and 132*d* in the shape of a series of posts 132*c* in the example shown in FIG. 14 and a single post in the example shown in FIG. 15, upstanding from and extending down the respective platforms 102*c* and 102*d*. In these examples, the the posts can have a smoothly domed top. Other configurations can also be seen by one of ordinary skill in the art.

Figure 16:
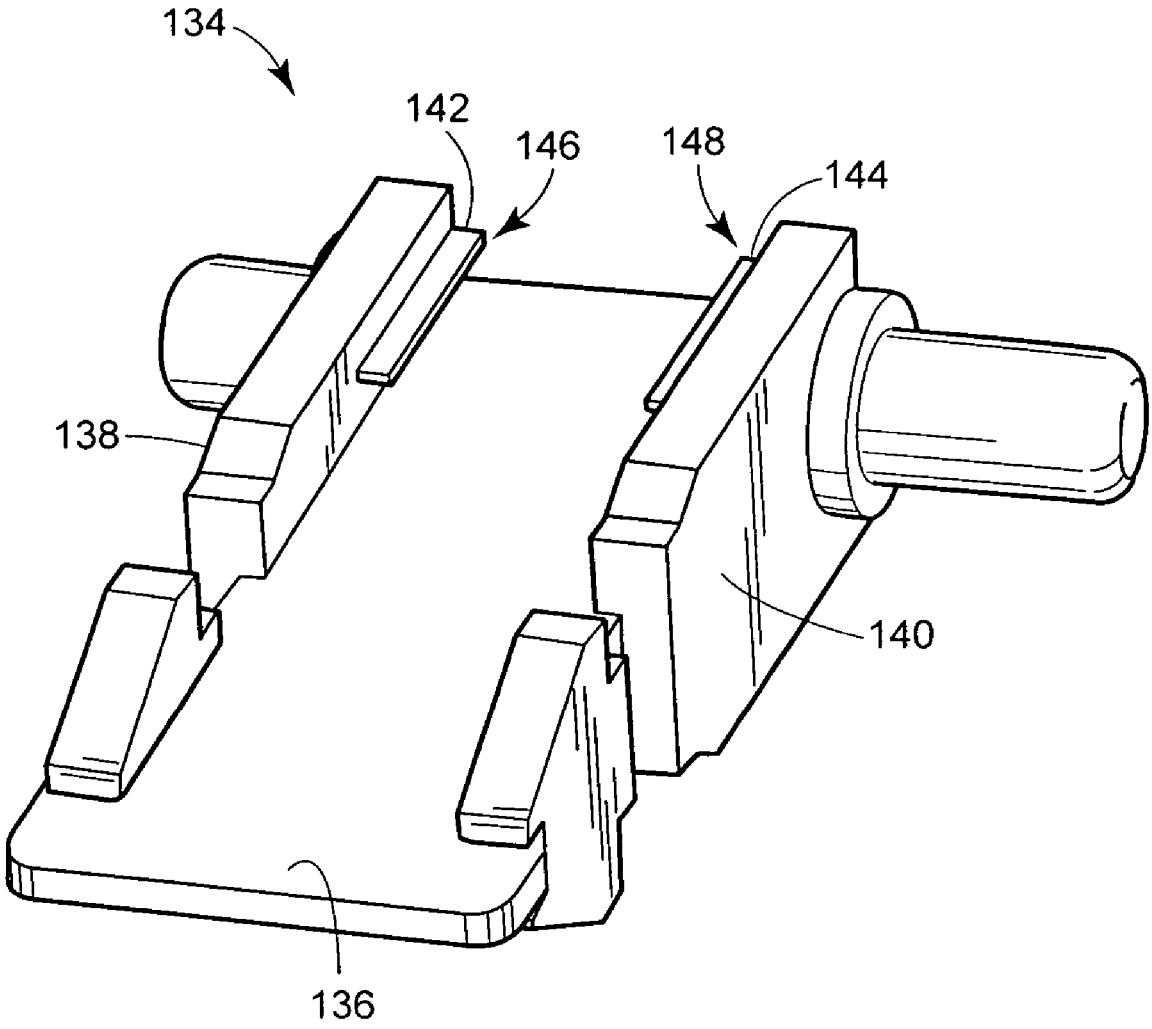
FIG. 16 is a perspective view of an alternate example of an applicator tip with structure to protect against the carrier tape folding over itself.

A alternate example of an applicator tip 134 is shown in FIG. 16. The applicator tip 134 includes a platform 116 with a left sidewall 138 and a right sidewall 140. Extending inward from the left sidewall 138 of the applicator tip 134 is a left protuberance 142. Extending inward from the right sidewall 140 is right protuberance 144. The right protuberance 144 can be similar to the left protuberance 142. A pair of channels 146, 148 are defined between the platform 136 and the protuberances 142, 144. The side edges 32*a*, 32*b* of the transfer tape 32 can travel in the channels 146, 148 to ensure that the transfer tape 32 does not fold over itself.

Figure 17:
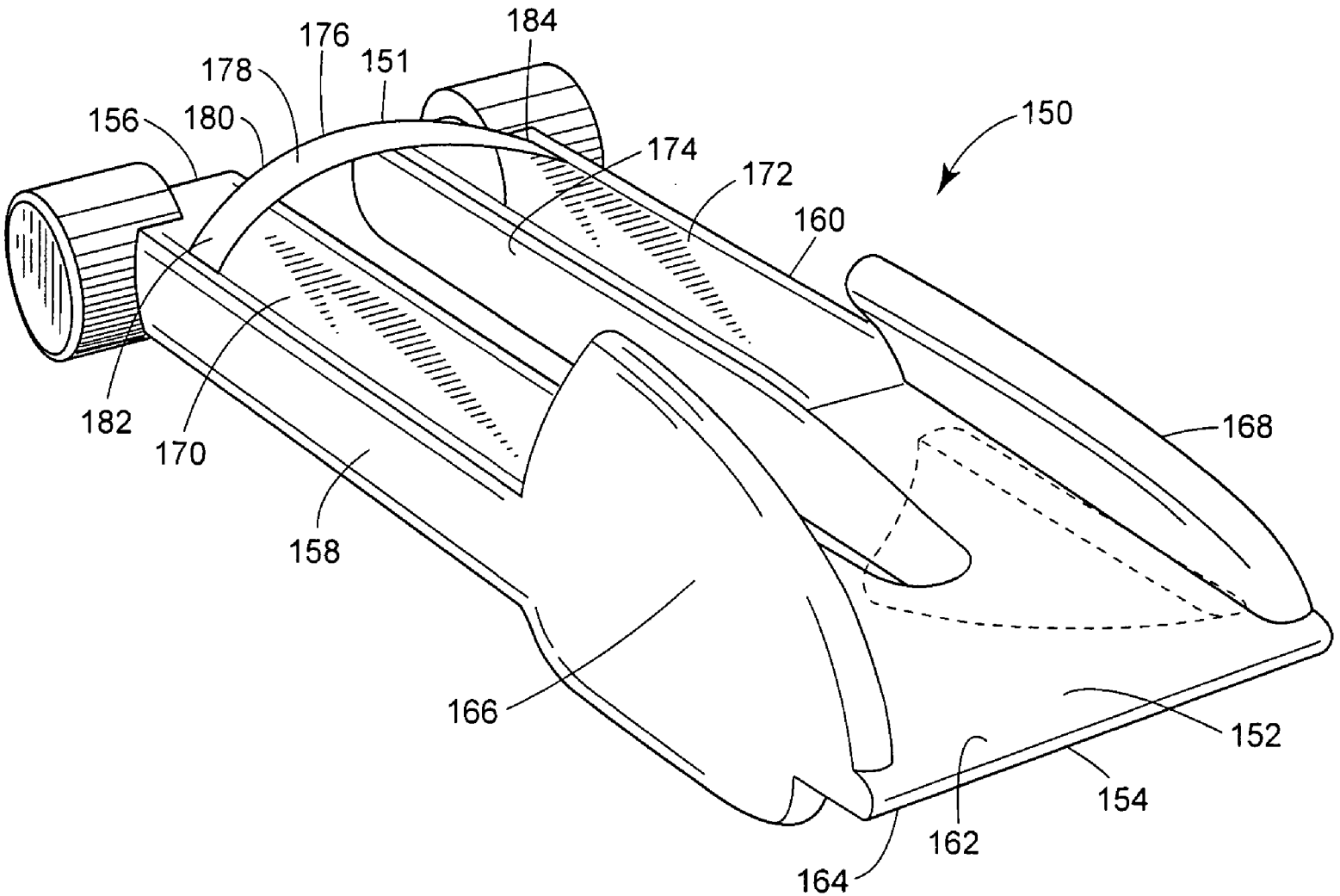
FIG. 17 is a perspective view of an alternate example of an applicator tip with structure to protect against the carrier tape folding over itself.

A further example of an applicator tip 150 and a protuberance 151 is disclosed in FIG. 17. The applicator tip 150 is similar in construction to an applicator tip disclosed in U.S. patent application Ser. No. 10/663,073, the teachings of which are hereby incorporated by reference.

The applicator tip 150 includes a platform 152 that is defined by a front edge 154, a back edge 156, a left edge 158, a right edge 160, a top surface 162 and a bottom surface 164. Adjacent the left edge 158 is a first sidewall 166, and adjacent the right edge 160 is a second sidewall 168. In this example the sidewalls 166, 168 are curved over the platform 152 to help to maintain the correction tape on the platform 152. Further, the platform 152 includes a first leg 170 and a second leg 172 separated by a longitudinal slot 174 to impart flexibility to the platform 152.

In this example, the protuberance 151 is defined by an arch 176 disposed near the back edge 156 on the top surface 162. The arch 176 has a convex surface 178 and a concave surface 180 and in this example serves the same purpose as the protuberance 132 in the previous example. The arch 176 includes a first end 182 attached to the first leg 170 and a second end 184 attached to the second leg 172 with the arch 176 spanning the slot 174.

In use, the transfer tape 32 is disposed over the convex surface 178 of the arch 176. The side edges 32*a* and 32*b* of the transfer tape are disposed near the first end 182 and second end 184, respectively, adjacent to the platform 152. The middle portion 32*c* rides along the convex surface 178 such that the transfer tape 32 is forced into a convex shape. This can help prevent the transfer tape 32 from folding over itself along its length.

As can be seen, any structure that helps to maintain the side edges 32*a*, 32*b* of the correction tape 32 adjacent the platform and/or force the middle portion 32*c* of the correction tape 32 upwards can be effective to prevent the correction tape 32 from folding over itself.

Finally, those of ordinary skill in the art will recognize that any applicator tip with a protuberance can be useful with any transfer tape dispenser, not only those disclosed herein. The applicator tip can take on any configuration with respect to at least size, flexibility, manufacturing materials, or other parameters. Further, the structure of the transfer tape dispenser 20 disclosed herein is only but one example of a dispenser that can be used with the application tip 28. Accordingly, the structure of the transfer tape dispenser 20 and its components can vary from that shown.

From the foregoing, one of ordinary skill in the art will appreciate that the present disclosure sets forth a flexible applicator tip for corrective tape. However, one of ordinary skill in the art could readily apply the novel teachings of this disclosure to any number of applicators. As such, the teachings of this disclosure shall not be considered to be limited to the specific examples disclosed herein, but to include all applications within the spirit and scope of the invention.

We claim:

1. An applicator tip adapted to guide correction tape within a correction tape dispenser, comprising:

a platform with a front edge, a rear edge, a first side edge, a second side edge, a supply side surface, and a return side surface, wherein the supply side surface, return side surface, and front edge are adapted to support a correction tape;

a first wall adjacent the first side edge of the platform, a second wall adjacent the second side edge of the platform; and tape contacting means adjacent the rear edge for preventing a length of the correction tape disposed over the platform from folding lengthwise over itself.

2. The applicator tip of claim 1, wherein the tape contacting means is a portion of a cylinder and is adapted to maintain the transfer tape in a convex configuration.

3. The applicator tip of claim 1, wherein the tape contacting means is a rail and is adapted to maintain the transfer tape in a convex configuration.

4. The applicator tip of claim 1, wherein the tape contacting means is a series of posts and is adapted to maintain the transfer tape in a convex configuration.

5. The applicator tip of claim 1, wherein the tape contacting means is a single post and is adapted to maintain the transfer tape in a convex configuration.

6. The applicator tip of claim 1, wherein the tape contacting means is an arch and is adapted to maintain the transfer tape in a convex configuration.

7. The applicator tip of claim 1, wherein the tape contacting means includes a protuberance extending from the first wall and over at least a portion of the supply side surface of the platform.

8. The applicator tip of claim 1, wherein each of the first wall and the second wall includes a groove that defines a respective front portion and a respective rear portion of each wall.

9. The applicator tip of claim 1, wherein the first wall and the second wall are curved over the platform.

10. The applicator tip of claim 1, wherein the platform includes a first leg and a second leg separated by a slot.

11. An applicator tip adapted to direct a transfer tape in a transfer tape dispenser, the applicator tip comprising:

a platform with a front edge, a rear edge, a first side edge, a second side edge, a supply side surface, and a return side surface, wherein the supply side surface, return side surface, and front edge are adapted to support a transfer tape;

a first wall adjacent the first side edge of the platform;

a second wall adjacent the second side edge of the platform; and a protuberance extending inwardly from the first wall and over at least a portion of the supply side surface of the platform, the protuberance being located adjacent the rear edge of the platform, wherein the protuberance is adapted to maintain an outer edge of the transfer tape adjacent to the supply side surface of the platform.

12. The applicator tip of claim 11, further comprising a second protuberance extending inwardly from the second wall and over at least a portion of the supply side surface of the platform.

13. A correction tape dispenser including the applicator tip of claim 11, further comprising a length of correction tape extending over the supply side surface, under the protuberance, and extending around the front edge.

14. A correction tape dispenser, comprising:

a housing;

a supply spool rotatably disposed within the housing;

a take-up spool rotatably disposed within the housing;

a transfer tape with a first end and a second end, wherein the first end is connected to the supply spool, and the second end is connected to the take-up spool;

an applicator tip partially disposed within the housing, the applicator tip including:

a platform with a front edge, a rear edge, a first side edge, a second side edge, a supply side surface, a return side surface, wherein the transfer tape extends from the supply spool, across the supply side surface, around the front edge, and to the take-up spool;

a first sidewall adjacent the first side edge; and a second sidewall adjacent the second side edge; and tape contacting means adjacent the rear edge for preventing a length of the tape disposed over the platform from folding lengthwise over itself.

15. The dispenser of claim 14, wherein the axis of rotation of the supply spool is not parallel to the front edge of the applicator tip.

16. The dispenser of claim 15, wherein the axis of rotation of the supply spool is approximately perpendicular to the front edge of the applicator tip.

17. The dispenser of claim 14, further including a cushion body located to cushion the force of the applicator tip against the housing during use.

18. The dispenser of claim 14, wherein the applicator tip is pivotably attached to the housing.

19. The dispenser of claim 14, wherein the tape contacting means includes a protuberance extending inwardly from the first wall and over at least a portion of the supply side surface of the platform, wherein the protuberance is adapted to maintain an outer edge of the transfer tape adjacent to the supply side surface of the platform.

20. An applicator tip adapted to direct a correction tape in a correction tape dispenser, the applicator tip comprising:

a platform with a front edge, a rear edge, a first side edge, a second side edge, a top surface, and a bottom surface, wherein the top surface, bottom surface, and front edge are adapted to support a transfer tape, a first wall adjacent the first side edge of the platform, a second wall adjacent the second side edge of the platform; and a first surface being located adjacent the rear edge of the platform and facing the top surface of the platform, the first surface associated with the first sidewall; and wherein the first surface is adapted to maintain an outer edge of the correction tape adjacent to the top surface of the platform.

21. The applicator tip of claim 20, further comprising a second surface facing the top surface of the platform, the second surface associated with the second sidewall.

22. A correction tape dispenser including the applicator tip of claim 20, further comprising a length of correction tape extending over the top surface, under the top surface, and extending around the front edge.

* * * * *

UNITED STATES PATENT AND TRADEMARK OFFICE

CERTIFICATE OF CORRECTION

PATENT NO. : 7,681,616 B2
APPLICATION NO. : 11/618596
DATED : March 23, 2010
INVENTOR(S) : Bret R. Marschand et al.

It is certified that error appears in the above-identified patent and that said Letters Patent is hereby corrected as shown below:

On the Cover Page:

At field (*), add -- This patent is subject to a terminal disclaimer. --.

Signed and Sealed this

Twenty-eighth Day of September, 2010

David J. Kappos

David J. Kappos
*Director of the United States Patent and Trademark Office*